United States Patent [19]

Touze

[11] Patent Number: 4,564,143

[45] Date of Patent: Jan. 14, 1986

[54] HOT-BLAST NOZZLES, PARTICULARLY FOR BLAST FURNACES

[76] Inventor: Francois Touze, Chateau de Logne, 57310 Guenange, France

[21] Appl. No.: 374,151

[22] Filed: May 3, 1982

[30] Foreign Application Priority Data

May 15, 1981 [FR] France ..... 81 09772

[51] Int. Cl.[4] ..... B05B 15/00

[52] U.S. Cl. ..... 239/132.3; 122/6.6

[58] Field of Search ..... 239/132.3, 424.5, 132.1, 239/135, 139; 122/6.6

[56] References Cited

U.S. PATENT DOCUMENTS

| | | | |
|---|---|---|---|
| 2,891,783 | 6/1959 | Eberhardt | 122/6.6 |
| 3,175,817 | 3/1965 | Smith et al. | 239/132.3 |
| 3,627,296 | 12/1971 | Uerlichs et al. | 239/132.3 |
| 3,638,932 | 2/1972 | Masella et al. | 239/132.3 |
| 3,652,013 | 3/1972 | Vasilievich et al. | 239/132.3 |
| 3,840,219 | 10/1974 | Sheridan et al. | 122/6.6 |
| 3,880,354 | 4/1975 | Van Horn | 239/132.3 |
| 4,155,702 | 5/1979 | Miller et al. | 239/132.3 |

FOREIGN PATENT DOCUMENTS 1601737 11/1981 United Kingdom .

*Primary Examiner*—Andres Kashnikow
*Assistant Examiner*—Michael J. Forman
*Attorney, Agent, or Firm*—Larson and Taylor

[57] ABSTRACT

The nozzle of the invention comprises a hollow tubular enclosure (1) in which is provided a hollow tubular chamber (10) coaxial with the enclosure and extending from the yoke (7) to the vicinity of the snout (5) thereof; the chamber (10) is connected through the yoke to a supply network (14) and at its circular front end it is provided with tangential orifices (15) for tangential injection of the cooling liquid on the internal surface of the snout.

19 Claims, 2 Drawing Figures

HOT-BLAST NOZZLES, PARTICULARLY FOR BLAST FURNACES

Figure 1:
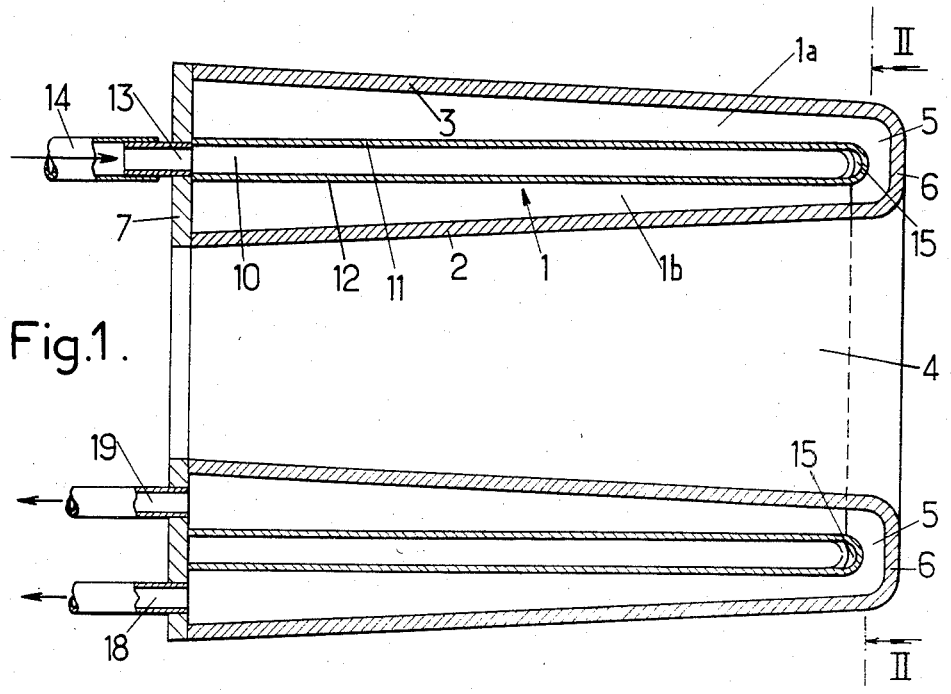

The present invention relates to improvements to hot-blast nozzles, particularly for blast furnaces, comprising:

1. an outer hollow tubular enclosure defined by two cylindrical or truncated cone shaped walls extending between a front part (snout) and a rear part through which flows a liquid cooling current,
2. an inner hollow tubular chamber substantially coaxial with the external enclosure and disposed at a radial distance from the lateral walls thereof, said inner chamber extending from said rear part of the outer enclosure to the immediate vinicity of the snout, and
3. liquid supply means for connecting said inner enclosure to a cooling liquid supply network and means for discharging the liquid connected to the outer enclosure.

A blast nozzle of this type is known from French Pat. No. FR 70 08475 (published under the No. 2 034 790), in which an internal partitioning system is provided defining helical paths for the cooling liquid.

A major drawback of this known blast nozzle is that the partitioning system is in the form of separate pieces welded to the inside of the enclosure. The result is very high manufacturing costs, not only because of the additional material required but also because of the difficulty of suitably assembling this blast nozzle; in particular it is difficult to provide adequate sealing between the wall of the enclosure and the helical dividing walls over the whole length thereof.

Furthermore, because the blast nozzle is exposed to an atmosphere at a very high temperature, the thermal stresses are very great and play a part, through the deformations which they cause, in impairing the quality of the sealing connection between the helical dividing walls and the wall of the enclosure.

Finally, the friction of the liquid on the helical dividing walls causes high pressure losses.

The aim of the invention is essentially to remedy the drawbacks which have just been set forth and to provide hot-blast nozzles used in blast furnaces which give better causes for satisfaction than in the past, particularly by using a structure which is simple to manufacture while increasing the efficiency of cooling, especially in the zone of the snout thereof, and reducing the flow of cooling liquid.

To these ends, it is provided for the injection means to further comprise at least one orifice opening tangentially into the front end of the inner chamber or in the vicinity of this end, so as to communicate to the cooling liquid a tangential component, and for the outer enclosure to have inwardly no obstacle likely to oppose the movement of the cooling liquid, whereby the cooling liquid is projected against the inner face of the snout of the enclosure, then is set in free helical rotational motion within the outer enclosure between the snout and the discharge means.

The cooling in the zone of the snout of the enclosure is made particularly efficient because the injection speed of the liquid, and substantially its rotational speed in the snout only depends on the conformation of the injector and on the pressure of the supply network; it is now very little dependent on the flowrate, contrary to what prevails in prior arrangements. By way of example, for the above considered speed (15 to 20 m/s on the snout), the flowrate may be only of the order of 3 to 5 $m^3$/hour. The whole liquid mass contained in the enclosure is set in rotation and shares in the cooling; the temperature rise of the water is increased and the efficiency, from the cooling point of view, is improved.

Because of the injection of the liquid directly into the zone of the snout of the enclosure, this especially exposed zone is well cooled. The result is an increased life expectancy of the blast nozzle, resulting in a smaller number of stoppages of the blast furnace for repair or exchange of the blast nozzles.

A more modest supply network is suitable for the lower liquid flowrate and the liquid consumption is less than heretofore. Furthermore, should the wall of a blast nozzle be pierced, the amount of liquid discharged into the blast furnace is considerably reduced, which minimizes the consequences of such an accident.

Generally, all the above mentioned advantages are accompanied by substantial saving of money, whereas in other respects manufacture of the blast nozzle in accordance with the invention remains easy, inexpensive and possible with traditional tools.

Figure 2:
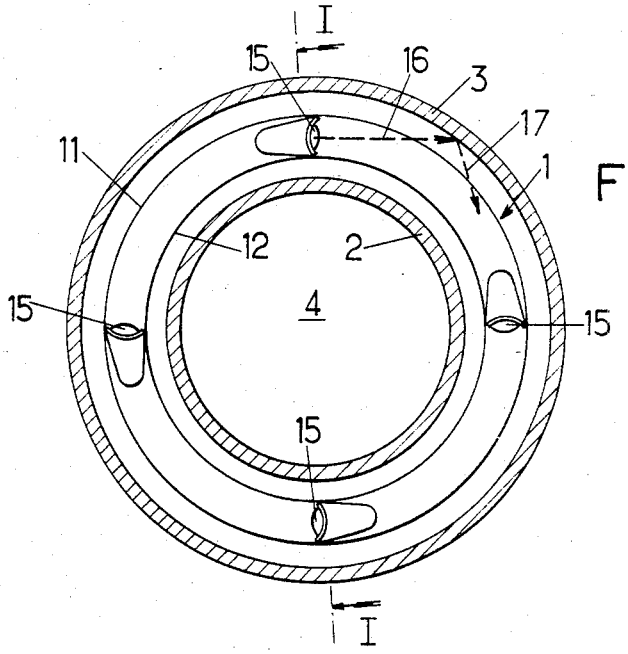

The invention will be better understood from reading the following description of a preferred embodiment, given solely by way of illustrative example; in this description, reference is made to the accompanying drawings in which:

FIG. 1 shows schematically in axial section a hot blast nozzle for a blast furnace constructed in accordance with the invention; and FIG. 2 is a section along II—II of FIG. 1.

As shown in the figures, the blast nozzle comprises a closed hollow tubular enclosure 1 defined laterally by two inner and outer walls, respectively 2 and 3, generally coaxial and of an elongated, cylindrical or, more frequently, slightly truncated cone shape, more especially for facilitating the positioning or withdrawal of the blast nozzle in the wall of the blast furnace. The inner wall 2 defines an axial passageway 4 for the hot gases.

At the front end, or snout 5, of the nozzle, the two lateral walls are connected together by a circular wall 6; at the rear end, there is provided a plate or yoke 7 with appropriate through openings (which will be discussed further on) for the incoming and outgoing cooling liquid.

In the functional position of assembly of the blast nozzle in the blast furnace, the snout projects inwardly of the blast furnace and is consequently the part of the blast nozzle the most exposed to heat. It is this part which should be cooled in the most efficient way possible.

For this purpose, there is disposed inside the enclosure 1, a closed inner hollow tubular chamber 10, defined by two lateral walls 11 and 12 which are cylindrical or the most often in the shape of a truncated cone depending on the shape adopted for the outer enclosure; these walls are coaxial, possibly parallel, to the walls 2 and 3 of the enclosure and extend from the yoke 7 as far as the zone of snout 5. This chamber 10 is connected, through an opening 13 formed through the yoke 7, to a cooling liquid (water) supply network 14. At its front end are provided several equidistant openings 15 providing communication between the chamber and enclosure 1. These openings are directed substantially tangentially to the chamber so that the pressurized liquid, coming from the intake orifice 13, is projected with a tangential component against the inner surface of wall 6 of snoot 5 (arrow 16 in FIG. 2), then by reflection at this point (arrow 17) begins a rotational movement along this surface of the snout while cooling it efficiently.

This tangential injection maintains the whole liquid mass contained in the enclosure in free helical motion, which, fairly rapidly rearwards of the snout, is divided into two separate flows in the same direction: a first helical flow bears against the inner surface of the outer wall 3 of the enclosure whereas the second helical flow bears against the outer surface of the inner wall 12 of chamber 10; in other words, two helical flows are propagated respectively in the two external 1*a* and internal 1*b* portions which chamber 10 defines within enclosure 1.

Outlet orifices 18 and 19 are provided in yoke 7 for discharging the liquid out of portions 1*a* and 1*b*, respectively.

The total section of openings 15 may advantageously be less than the total section of openings 18,19.

As is evident and as it follows moreover already from what has gone before, the invention is in no wise limited to those of its modes of application and embodiments which have been more especially considered; it embraces, on the contrary, all variations thereof.

I claim:

1. A hot-blast nozzle, particularly for a blast furnace, comprising:

an outer hollow tubular enclosure defined by two substantially cylindrical walls extending between a front part or and a rear part and through which a current of a supplied cooling liquid can flow, an inner hollow tubular chamber substantially coaxial with the outer enclosure and disposed at a radial distance from the substantially cylindrical walls thereof, said inner chamber having a rear end located at said rear part of the outer enclosure and a front end located in the immediate vicinity of said snout;

liquid supply means for connecting said inner enclosure to a cooling liquid supply network; and means for discharging a supplied cooling liquid connected to the outer enclosure;

characterized in that said nozzle further comprises at least one orifice located substantially in the front end of the inner chamber and opening tangentially into said enclosure so as to communicate to the supplied cooling liquid a tangential component; and characterized in that the outer enclosure has inwardly no obstacle likely to oppose the movement of the cooling liquid, whereby said orifice and said obstacle-free outer enclosure are such that the cooling liquid is projected against the inner face of the snout of the enclosure and then set in free helical rotational motion within the outer enclosure between the snout and the discharge means.

2. The blast nozzle as claimed in claim 1, characterized in that the inner chamber has several orifices spaced angularly evenly from each other.

3. The blast nozzle as claimed in claim 1, characterized in that the total area through which the supplied cooling liquid can flow from the inner chamber into the outer enclosure is less than the total area of the discharge means through which the supplied cooling liquid can flow out of said nozzle, thereby ensuring discharge of the liquid from the enclosure.

4. The blast nozzle as claimed in claim 1, characterized in that the cross-sectional area through which the supplied cooling liquid flows from the inner chamber to the outer enclosure has a size so as to produce a predetermined cooling liquid flowrate and wherein the maximum flow rate through said nozzle is limited solely by said cross-sectional area.

5. The blast nozzle as claimed in claim 1 wherein said enclosure walls are truncated cone shaped walls.

6. A hot-blast nozzle, particularly for a blast furnace, comprising;

a hollow tubular annular enclosure defined by two substantially coaxial side walls extending between a front part or nose and a rear part, a hollow tubular annular chamber located in the inside of said enclosure substantially coaxially with said enclosure, said chamber being defined by two coaxial substantially cylindrical side walls connected together at a front end of said chamber and disposed at a radial distance from the side walls of said enclosure, said chamber having a rear end located at said rear part of the enclosure and said front end located in the immediate rear vicinity of said nose;

liquid supply means for connecting said chamber to a cooling liquid supply network;

means connected to the enclosure for discharging the cooling liquid; and at least one orifice located substantially in the front end of said chamber and forming a passage between said chamber and said enclosure, said orifice opening tangentially into said enclosure, and said enclosure having no substantial inner obstacle, such that in use a cooling liquid flows through the orifice into the enclosure with a tangential component of speed that the liquid is projected against the inner face of said nose of the enclosure and then is set in free helical rotational motion within the enclosure from the nose to the discharge means.

7. The blast nozzle as claimed in claim 6, characterized in that the chamber has several orifices spaced angularly evenly from each other.

8. The blast nozzle as claimed in claim 7, characterized in that the total area through which the liquid flows from the chamber into the enclosure is less than the total area of the discharge means through which the liquid flows thereby ensuring discharge of the liquid from the enclosure.

9. The blast nozzle as claimed in claim 8 characterized in that there are a plurality of orifices in said chamber front end, said orifices have a predetermined size based as a function of the cooling liquid flowrate.

10. The blast nozzle as claimed in claim 9 wherein said enclosure has at least one opening located substantially in said rear part of said enclosure; and wherein the total cross-sectional size of all of said orifices in said chamber front end is selected such that the total combined cross-sectional size thereof is less than the total cross-sectional size of all of said enclosure openings.

11. The blast nozzle as claimed in claim 6, characterized in that the total area through which the liquid flows from the chamber into the enclosure is less than the total area of the discharge means through which the liquid flows thereby ensuring discharge of the liquid from the enclosure.

12. The blast nozzle as claimed in claim 6, wherein said enclosure, said walls and said chamber side walls are truncated cone shaped walls.

13. The blast nozzle as claimed in claim 6 characterized in that the total cross-sectional area through which the cooling liquid flows from the inner chamber to the outer enclosure has a predetermined size based as a function of the cooling liquid flowrate.

14. The blast nozzle as claimed in claim 6 wherein the total cross-sectional area through which the cooling liquid flows from the inner chamber to the outer enclosure has a size that is less than the total cross-sectional size of the discharging means.

15. A hot-blast nozzle, particularly for a blast furnace comprising;

a front nose, a rear part, two coaxial enclosure side walls extending between the nose and the rear part and defining an annular enclosure, two coaxial chamber side walls located inside the enclosure and substantially coaxial therewith, the chamber side walls spaced a radial distance from corresponding ones of the enclosure side walls and extending from the rear part to the immediate rear vicinity of the nose where they are connected together to form a front end whereby the chamber side walls define therebetween an annular chamber, liquid supply means for connecting the chamber to a cooling liquid supply network, and means connected to the enclosure for discharging the cooling liquid;

characterized in that said nozzle further comprises;

means for supporting the enclosure side walls and the chamber side walls such that there is no substantial inner obstacle in the enclosure;

at least one orifice in the chamber side walls located substantially in the front end of the chamber and providing a passageway between the chamber and the enclosure, said at least one orifice opening tangentially into the enclosure such that a cooling liquid flows through said at least one orifice into the enclosure with a tangential component of speed and is projected against the inner face of the enclosure nose, whereby said orifice is so arranged and said enclosure and chamber side walls are mounted and are so substantially obstacle free that a cooling liquid emitted from said at least one orifice is set in free helical rotational motion within the enclosure from the nose to the discharge means.

16. The blast nozzle as claimed in claim 15 and further comprising a plurality of said orifices all said orifices being evenly, angularly spaced from each other.

17. The blast nozzle as claimed in claim 16, characterized in that the total area through which the liquid flows from the chamber into the enclosure is less than the total area of the discharge means through which the liquid flows thereby ensuring discharge of the liquid from the enclosure.

18. The blast nozzle as claimed in claim 15, characterized in that the total area through which the liquid flows from the chamber into the enclosure is less than the total area of the discharge means through which the liquid flows thereby ensuring discharge of the liquid from the enclosure.

19. The blast nozzle as claimed in claim 15, wherein the enclosure side walls and the chamber side walls are truncated cone shaped walls.

* * * * *